US012723591B2

(12) United States Patent
Sarte

(10) Patent No.: US 12,723,591 B2
(45) Date of Patent: Sep. 1, 2026

(54) PORTABLE FAN DEVICE

(71) Applicant: Mary Sarte, Long Beach, CA (US)

(72) Inventor: Mary Sarte, Long Beach, CA (US)

( * ) Notice: Subject to any disclaimer, the term of this patent is extended or adjusted under 35 U.S.C. 154(b) by 0 days.

(21) Appl. No.: 18/973,827

(22) Filed: Dec. 9, 2024

(65) Prior Publication Data

US 2026/0160258 A1 Jun. 11, 2026

(51) Int. Cl.

| | |
|---|---|
| ***F04D 25/08*** | (2006.01) |
| ***A41D 13/002*** | (2006.01) |
| ***F04D 25/06*** | (2006.01) |
| ***F04D 29/52*** | (2006.01) |
| ***F04D 29/66*** | (2006.01) |

(52) U.S. Cl.

CPC ..... *F04D 25/08* (2013.01); *A41D 13/0025* (2013.01); *F04D 25/06* (2013.01); *F04D 25/0673* (2013.01); *F04D 25/084* (2013.01); *F04D 29/522* (2013.01); *F04D 29/664* (2013.01)

(58) Field of Classification Search

CPC .... F04D 25/084; F04D 25/0673; F04D 25/08; F04D 25/086; F04D 29/441; F04D 29/522; F04D 29/4246; A41D 13/25

See application file for complete search history.

(56) References Cited

U.S. PATENT DOCUMENTS

| | | | | |
|---|---|---|---|---|
| 4,799,858 | A | 1/1989 | Shin-Chin | |
| 8,696,300 | B1 * | 4/2014 | Burke, Jr. | F04D 25/08 415/214.1 |
| 9,352,064 | B2 * | 5/2016 | Furner | A61L 9/122 |
| 9,364,574 | B2 * | 6/2016 | Saleh | A01M 29/12 |
| 10,570,920 | B2 * | 2/2020 | Lee | F04D 25/08 |
| 10,808,708 | B2 | 10/2020 | Xu | |
| 11,022,127 | B2 | 6/2021 | Hiner | |
| 11,378,086 | B2 | 7/2022 | Ikeuchi | |

(Continued)

FOREIGN PATENT DOCUMENTS

| | | | |
|---|---|---|---|
| CN | 220118374 U | * | 12/2023 |
| JP | 3147515 U | * | 1/2009 |

(Continued)

OTHER PUBLICATIONS

English Translation of KR-200352471-Y1 (Year: 2004).*

(Continued)

*Primary Examiner* — Courtney D Heinle
*Assistant Examiner* — Wesley Le Fisher

(57) ABSTRACT

A portable fan device for discreetly and efficiently cooling a user includes a housing having an interior space and a processor electrically coupled to a motor. An inlet vent and an outlet vent extend through the housing. A propeller is operably coupled to the motor wherein the motor is actuatable to rotate the propeller. The propeller is rotatable about an axis extending between the inlet vent and the outlet vent. A wall positioned within the interior space defines a channel. The channel is in fluid communication with the inlet vent and the outlet vent wherein the propeller draws air into the channel through the inlet vent and wherein the channel is configured to direct airflow through the housing to the outlet vent. A clip is coupled to the housing wherein the clip is designed to removably secure the housing to a user.

13 Claims, 11 Drawing Sheets

(56) References Cited

U.S. PATENT DOCUMENTS

| | | | | |
|---|---|---|---|---|
| 11,747,041 | B2 * | 9/2023 | Chothave | F24F 13/24 181/224 |
| D1,011,507 | S | 1/2024 | Zhu | |
| 12,378,968 | B1 * | 8/2025 | Zhu | F04D 25/084 |
| 2011/0038761 | A1 * | 2/2011 | Saleh | A61L 9/122 422/124 |
| 2014/0093404 | A1 * | 4/2014 | Long | F04D 25/084 417/234 |
| 2020/0332809 | A1 | 10/2020 | Buxton | |
| 2025/0237224 | A1 * | 7/2025 | Zhu | F04D 19/002 |

FOREIGN PATENT DOCUMENTS

| | | | | |
|---|---|---|---|---|
| JP | 3173011 U | * | 1/2012 | |
| KR | 200352471 Y1 | * | 6/2004 | F04D 25/084 |
| WO | WO2005068846 | | 7/2005 | |

OTHER PUBLICATIONS

English Translation of CN-220118374-U (Year: 2023).*
English Translation of JP-3147515-U (Year: 2009).*
English Translation of JP-3173011-U (Year: 2012).*

* cited by examiner

PORTABLE FAN DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to fans and more particularly pertains to a new fan for discreetly and efficiently cooling a user.

(2) Description of Related Art Including Information Disclosed Under 37 CFR 1.97 and 1.98

The prior art relates to fans. Fans come in many different shapes and sizes, and have evolved alongside humanity for centuries. Some of the first fans were simply, flat surfaces like leaves or feathers that were attached to a handle. Electric fans were invented in the 1880s and used motors to rotate blades, creating the airflow that helped users to cool down. Ceiling fans were invented shortly thereafter, although they were not marketed for household use until the 1910. Throughout the 1900s, fans because safer, cheaper, and more energy efficient. However, the necessary rotation of the blades continues to create a substantial amount of noise. Thus, there is a need in the art for a fan that can operate quietly to discreetly help users cool down. Ideally, such a device would be small enough that the device could be carried with a user, for example by being attached to a bag or an article of clothing.

(h) BRIEF SUMMARY OF THE INVENTION

An embodiment of the disclosure meets the needs presented above by generally comprising a housing having an interior space. A processor is positioned within the interior space. A motor is electrically coupled to the processor. An inlet vent extends through the housing. An outlet vent extends through the housing. The outlet vent is spaced from the inlet vent. A propeller is operably coupled to the motor wherein the motor is actuatable to rotate the propeller. The propeller is rotatable about an axis extending between the inlet vent and the outlet vent. A wall defines a channel extending through the interior space. The propeller is positioned within the channel. The channel is in fluid communication with the inlet vent and the outlet vent wherein the propeller is configured to draw air into the channel through the inlet vent and wherein the channel is configured to direct airflow through the housing to the outlet vent. A clip is coupled to the housing wherein the clip is configured to removably secure the housing to a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
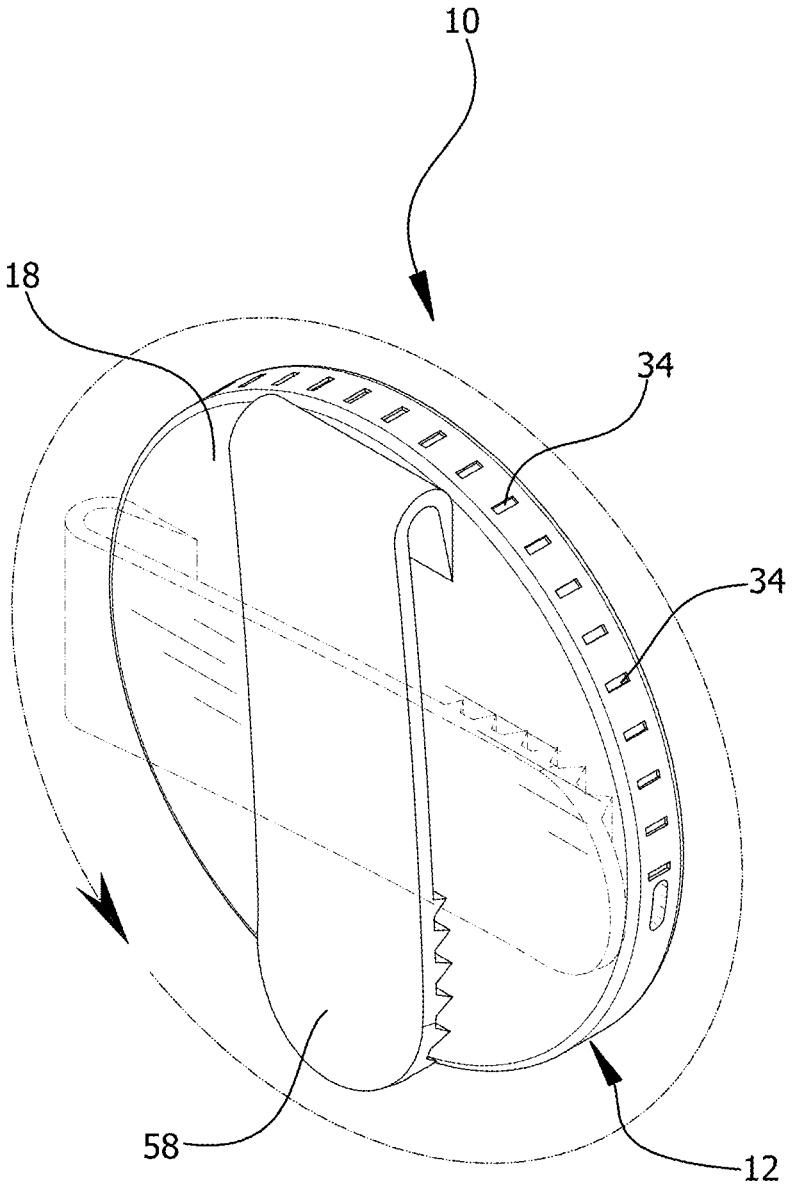
FIG. 1 is a rear perspective view of a portable fan device according to an embodiment of the disclosure.
Figure 2:
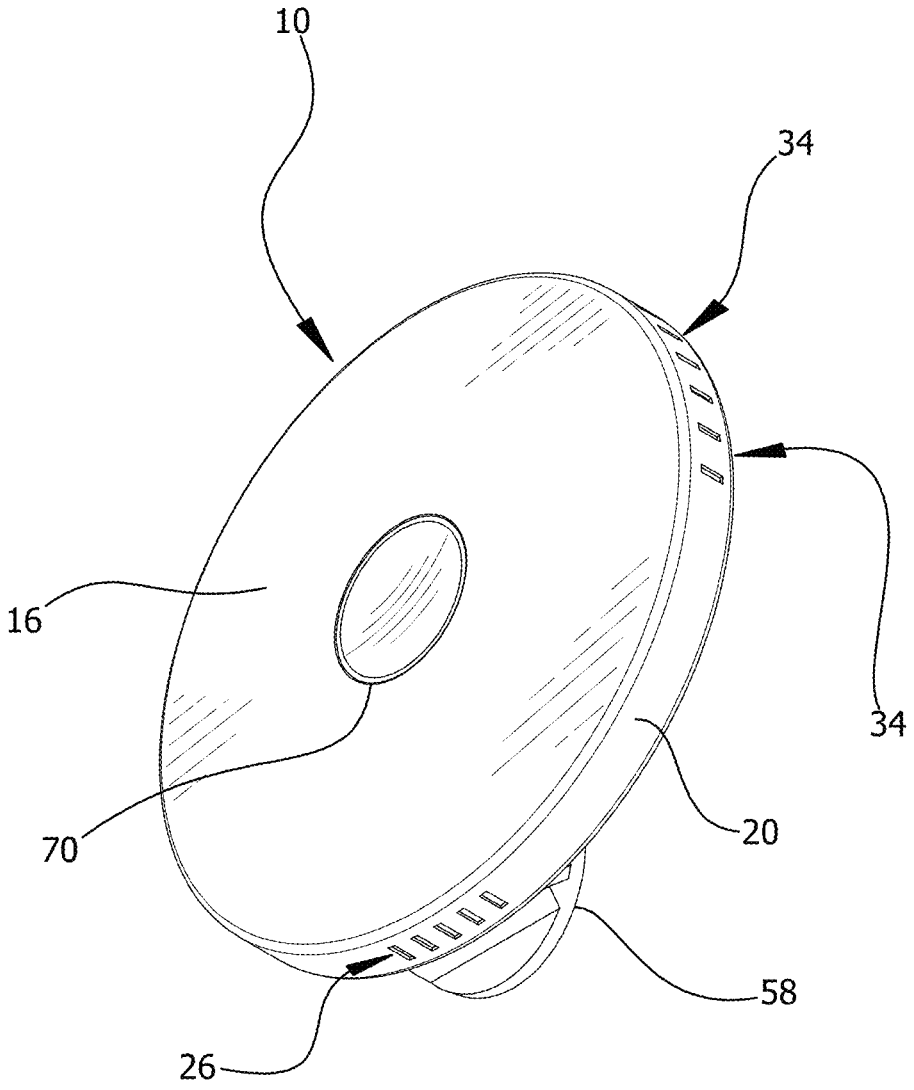
FIG. 2 is a front perspective view of an embodiment of the disclosure.
Figure 3:
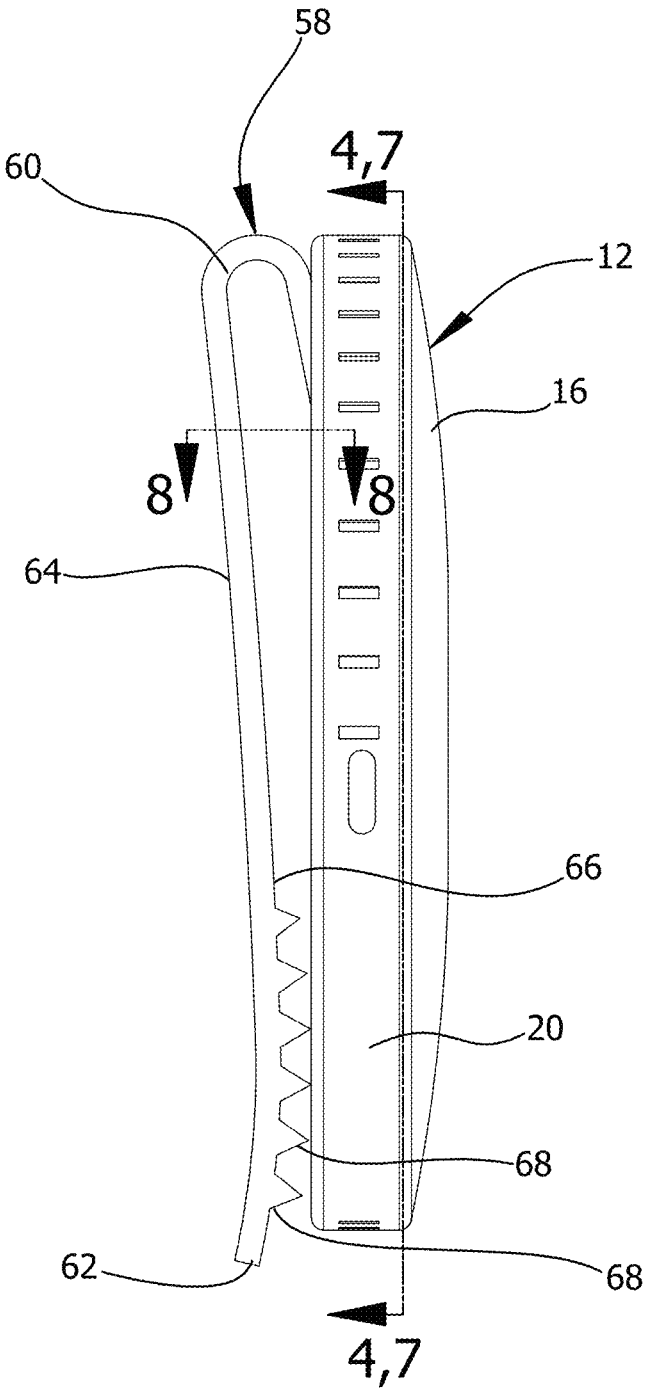
FIG. 3 is a side view of an embodiment of the disclosure.

With reference now to the drawings, and in particular to FIGS. 1 through 11 thereof, a new fan embodying the principles and concepts of an embodiment of the disclosure and generally designated by the reference numeral 10 will be described.

As best illustrated in FIGS. 1 through 11, the portable fan device 10 generally comprises a housing 12 having an interior space 14. The housing 12 generally has a front side 16, a back side 18, and a peripheral side 20 that is coupled to and extends between the front side 16 and the back side 18 to define the interior space 14. The front side 16 and the back side 18 may be circular, as shown in the drawings, although alternative shapes are also contemplated.

For example, the front side 16 may have a diameter that is between 1.0 inch and 3.0 inches. The back side 18 may have a diameter that is equal to the diameter of the front side 16. The housing 12 generally has a width that is measured between the front side 16 and the back side 18. For example, the width of the housing 12 may be between 0.25 inches and 1.0 inches. The housing 12 may include a plastic material. The plastic material may be coated in a silicone rubber material. Alternative materials are also contemplated for the housing 12.

A processor 22 is positioned within the interior space 14. A motor 24 is electrically coupled to the processor 22. The motor 24 is positioned within the interior space 14. The motor 24 may be a brushless electric motor 24 to reduce noise which may be emitted by operation of the motor 24.

A plurality of inlet vents 26 extend through the housing 12. The plurality of inlet vents 26 are generally positioned on the peripheral side 20 of the housing 12. In certain embodiments, the plurality of inlet vents 26 may include a single inlet vent. In other embodiments, the plurality of inlet vents 26 generally include a primary inlet vent 28 and a terminal inlet vent 30 that is spaced from the primary inlet vent 28. A middle inlet vent 32 is generally positioned between the primary inlet vent 28 and the terminal inlet vent 30. For example, the middle inlet vent 32 may be centered between the primary inlet vent 28 and the terminal inlet vent 30.

A plurality of outlet vents 34 extend through the housing 12. The plurality of outlet vents 34 are generally positioned on the peripheral side 20 of the housing 12. The plurality of outlet vents 34 are spaced from the plurality of inlet vents 26. In certain embodiments, the plurality of outlet vents 34 may include a single outlet vent.

In other embodiments, the plurality of outlet vents 34 may generally include a first outlet vent 36 and a final outlet vent 38 that is spaced from the first outlet vent 36. The final outlet vent 38 may be horizontally aligned with the first outlet vent 36 across the front side 16 of the housing 12. For example, the first outlet vent 36 and the final outlet vent 38 may define an angle 40 that is between 160.0° and 200.0°. In a preferred embodiment, the angle 40 defined by the first outlet vent 36 and the final outlet vent 38 is 180.0°.

A central outlet vent 86 may be vertically aligned with the middle inlet vent 32 of the plurality of inlet vents 26 across the housing 12. The central outlet vent 86 is positioned between the first outlet vent 36 and the final outlet vent 38. For example, the central outlet vent 86 may be centered between the first outlet vent 36 and the final outlet vent 38.

A propeller 42 is operably coupled to the motor 24 wherein the motor 24 is actuatable to rotate the propeller 42. The propeller 42 is positioned within the interior space 14. More specifically, the propeller 42 is generally positioned adjacent to the plurality of inlet vents 26. The propeller 42 is rotatable about an axis 44 that extends across the housing 12. More specifically, the axis 44 generally extends between the middle inlet vent 32 of the plurality of inlet vents 26 and the central outlet vent 86 of the plurality of outlet vents 34. Rotation of the propeller 42 is configured to draw air inwardly through the plurality of inlet vents 26 and direct air outwardly through the plurality of outlet vents 34. In a preferred embodiment, the axis 44 about which the propeller 42 is rotated may be perpendicular to the angle 40 is defined between the first outlet vent 36 and the final outlet vent 38.

A wall 46 may be positioned within the interior space 14. The wall 46 defines a channel extending through the interior space 14. The propeller 42 is generally positioned within the channel 88. The channel 88 is in fluid communication with the plurality of inlet vents 26 and with the plurality of outlet vents 34. The propeller 42 is configured to draw air into the channel 88 through the plurality of inlet vents 26. The channel 88 is configured to direct airflow through the housing 12 to the plurality of outlet vents 34.

The wall 46 may include a soundproofing material wherein the soundproofing material is configured to inhibit sound waves emitted by rotation of the propeller 42 from travelling through the wall 46 and outwardly from the housing 12. Examples of the soundproofing material include polyurethane foams, felt, polyester fiber, fiber glass, cork, silicone, and epoxy, amongst others. The soundproofing material may have a density is configured to absorb and dampen the sound waves that are emitted by rotation of the propeller 42. The soundproofing material may also have a porosity that is configured to expand, compress, and change direction of flow of sound waves through the housing 12.

The wall 46 may include a first lateral side 48 that is positioned proximate to the primary inlet vent 28 of the plurality of inlet vents 26. In other words, the first lateral side 48 may be spaced from the middle inlet vent 32. A second lateral side 50 is generally positioned proximate to the terminal inlet vent 30 of the plurality of inlet vents 26. In other words, the second lateral side 50 may be spaced from the middle inlet vent 32. The propeller 42 is generally positioned between the first lateral side 48 and the second lateral side 50.

The first lateral side 48 and the second lateral side 50 may be angled to extend upwardly from the peripheral side 20 proximate to the plurality of inlet vents 26 and outwardly relative to each other. Accordingly, a distance between the first lateral side 48 and the second lateral side 50 may increase moving away from the plurality of inlet vents 26. The distance between the first lateral side 48 and the second lateral side 50 may be measured perpendicularly to the axis 44 about which the propeller 42 is rotated. In other words, the first lateral side 48 and the second lateral side 50 may define a cone shape or a V-shape between the plurality of inlet vents 26 and the plurality of outlet vents 34.

Figure 4:
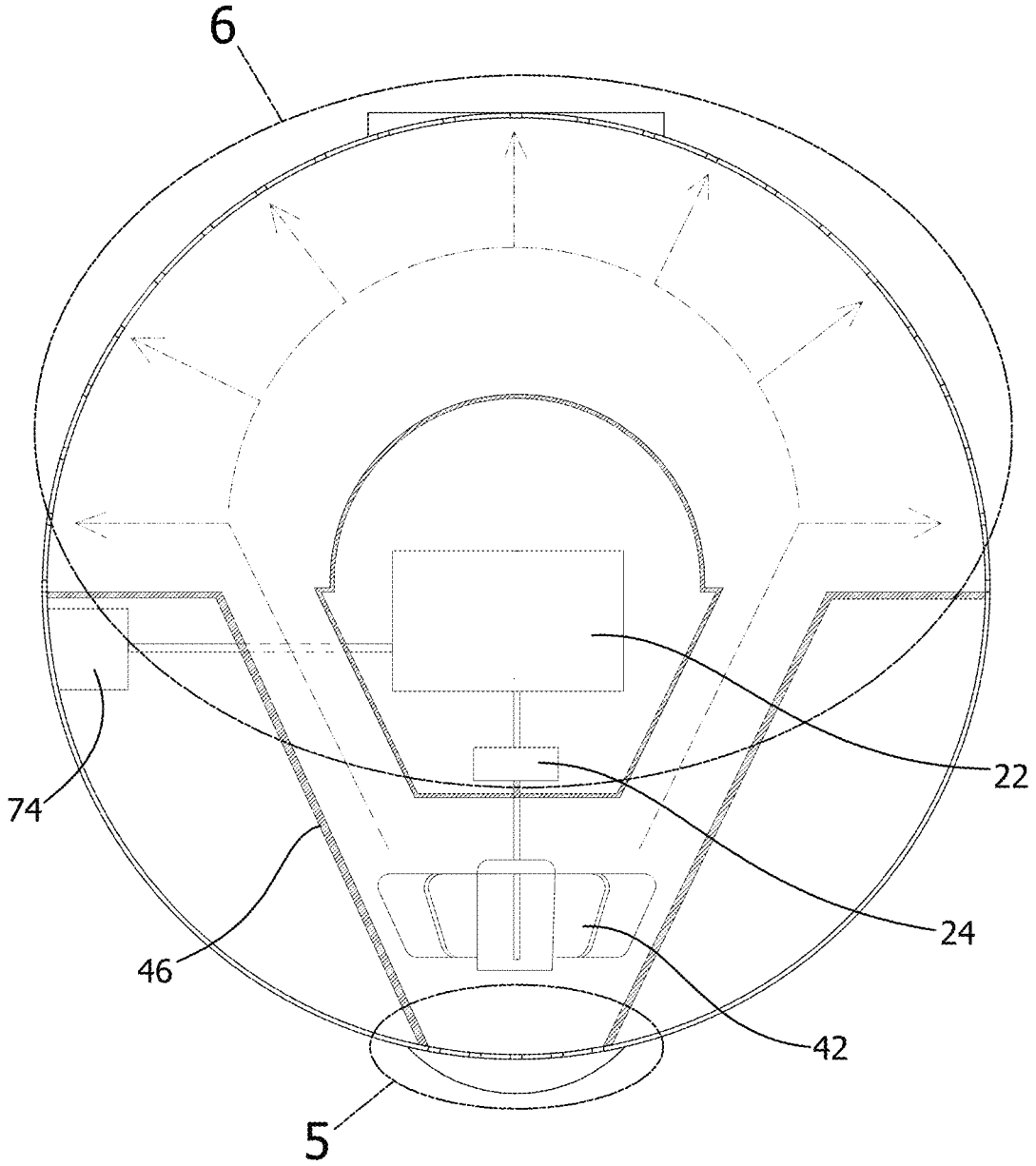
FIG. 4 is a cross-sectional view of an embodiment of the disclosure.
Figure 5:
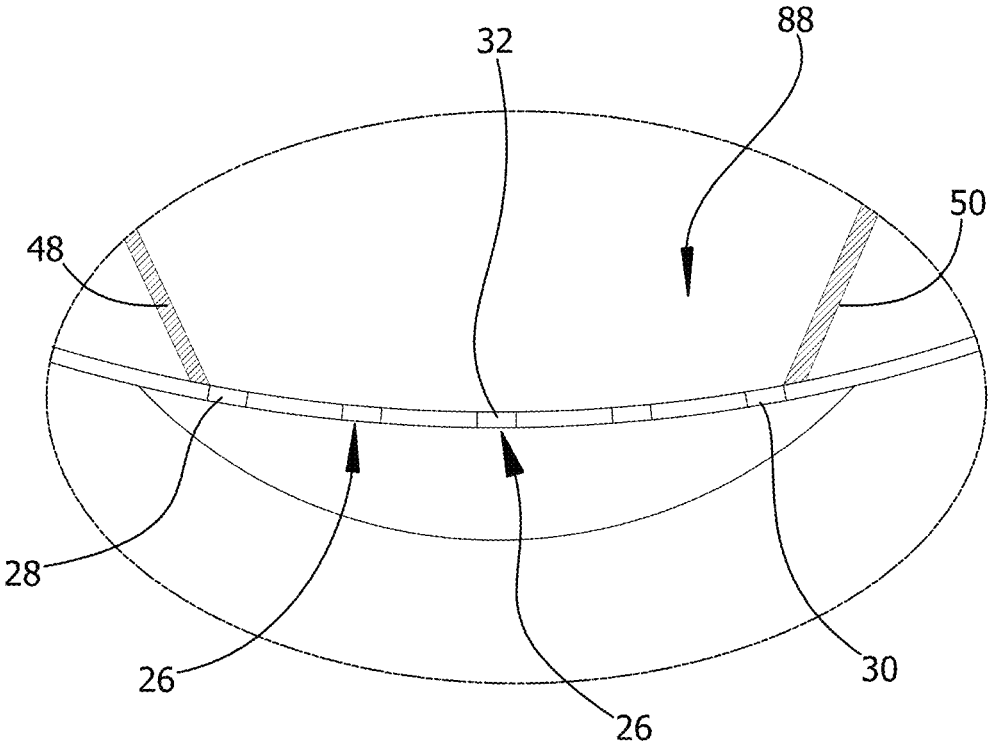
FIG. 5 is a detail view of an embodiment of the disclosure.
Figure 6:
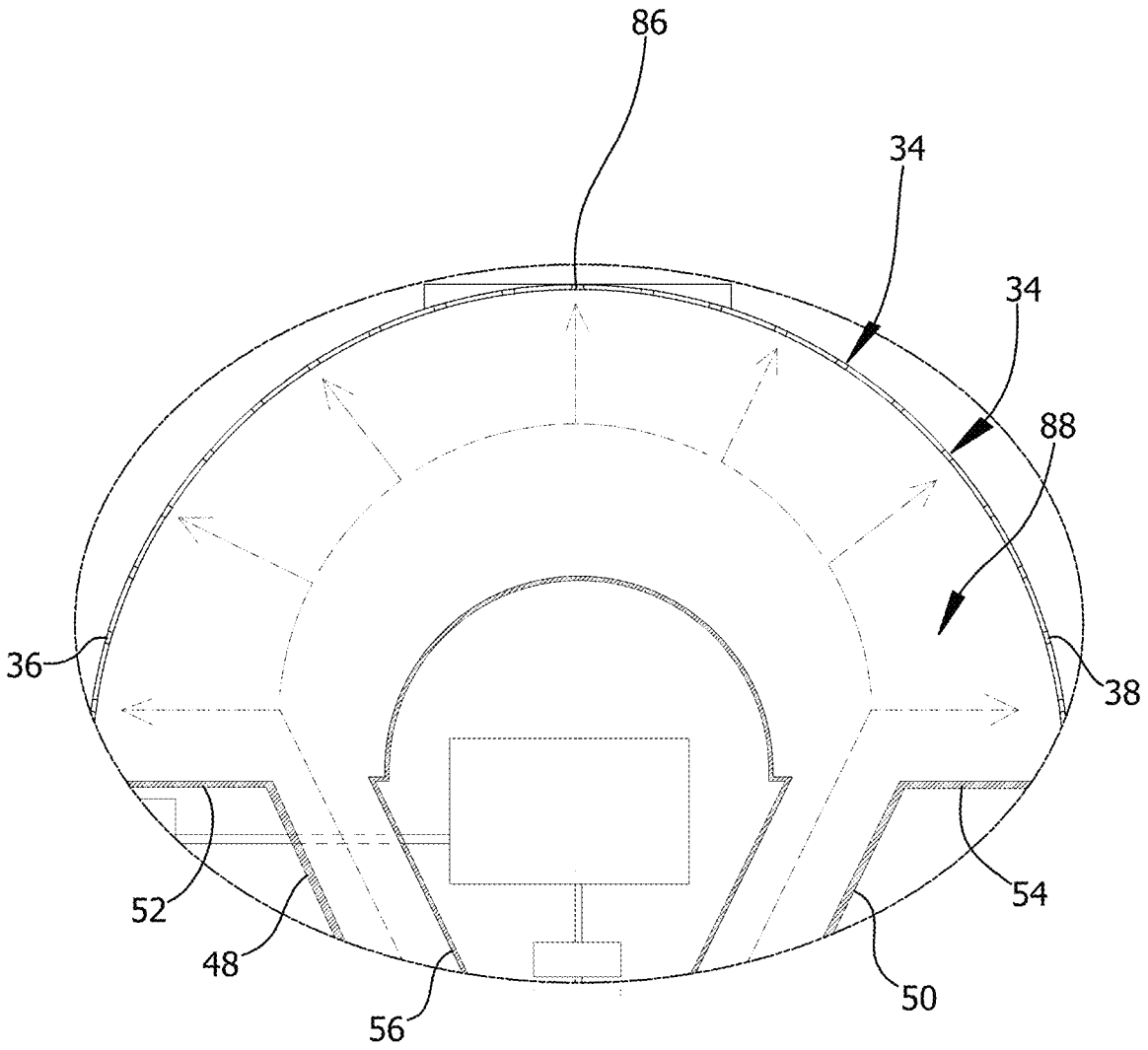
FIG. 6 is a detail view of an embodiment of the disclosure.
Figure 7:
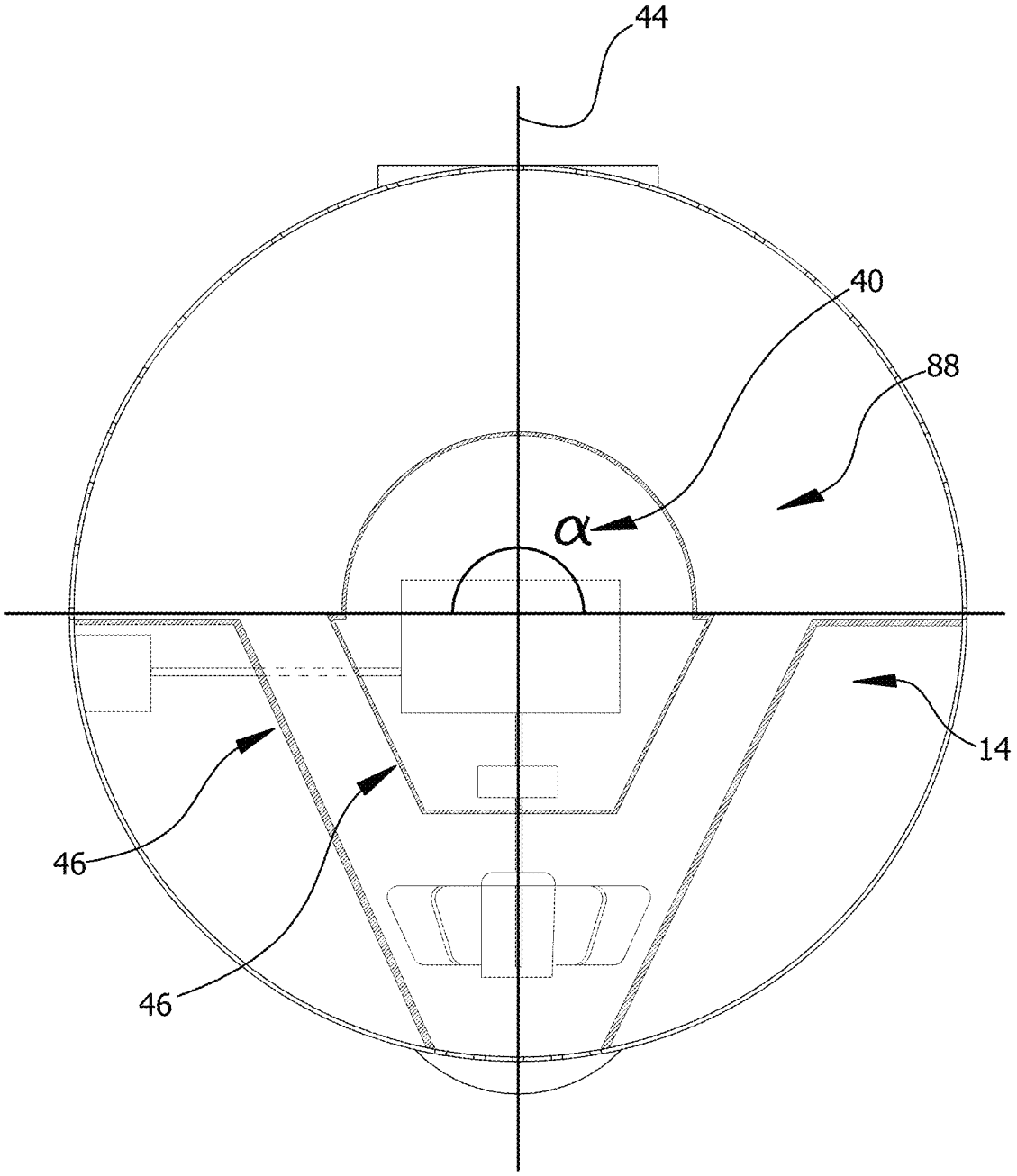
FIG. 7 is a cross-sectional view of an embodiment of the disclosure.
Figure 8:
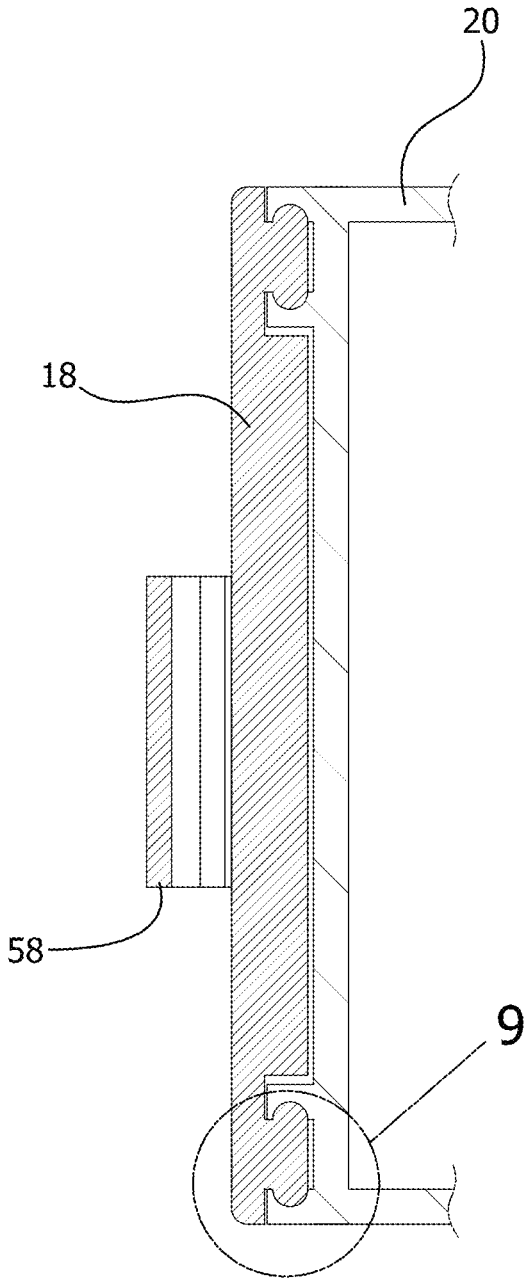
FIG. 8 is a cross-sectional view of an embodiment of the disclosure.
Figure 9:
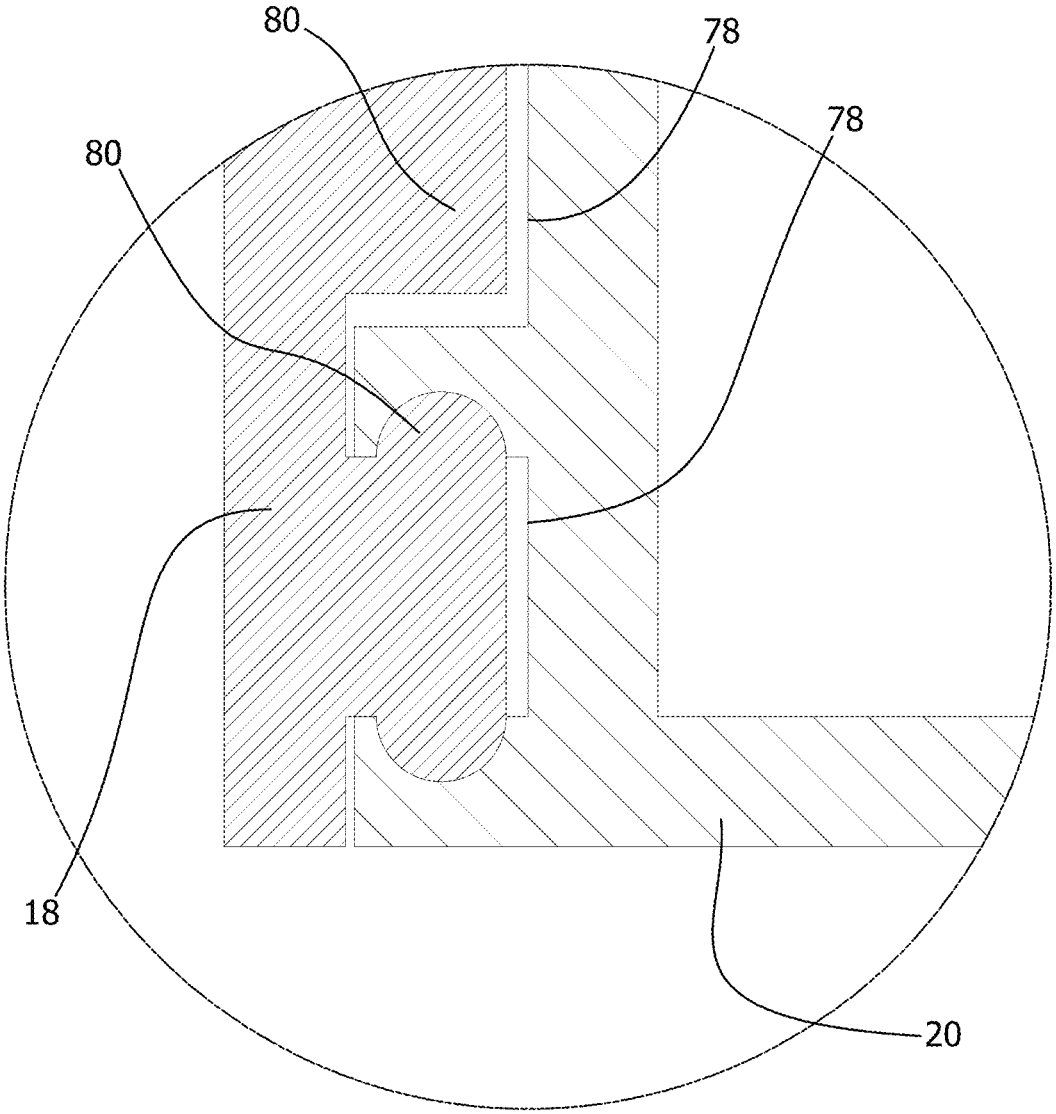
FIG. 9 is a detail view of an embodiment of the disclosure.

The shape defined by the first lateral side 48 and the second lateral side 50 causes the channel 88 to widen moving toward the plurality of outlet vents 34, with air entering the housing 12 where the channel 88 is narrowest and exiting the housing 12 where the channel 88 is widest. The channel 88 may thereby create negative pressure between the plurality of inlet vents 26 and the plurality of outlet vents 34. Air that is outside of the housing 12 and near the plurality of inlet vents 26 will want to fill this area of negative pressure, drawing air through the plurality of inlet vents 26 and into the propeller 42. Air around the housing 12 may also begin to move into the housing 12 in the direction defined by the channel 88, increasing a flow rate of air through the housing 12 and a volume of air which can be expelled through the plurality of outlet vents 34. As shown in FIGS. 4 and 7, the propeller 42 itself may have a width that increases moving away from the plurality of inlet vents 26 toward the plurality of outlet vents 34, which may further increase the negative pressure created near the plurality of inlet vents 26.

A first extension 52 of the wall 46 may be coupled to and extend from the first lateral side 48 of the wall 46 to the peripheral side 20 of the housing 12. The first extension 52 may be perpendicular to the axis 44 about which the propeller 42 is rotated, as shown in FIG. 7. The first extension 52 is generally positioned adjacent to the first outlet vent 36 of the plurality of outlet vents 34.

A second extension 54 of the wall 46 may be coupled to and extend from the second lateral side 50 of the wall 46 to the peripheral side 20 of the housing 12. The second extension 54 may be parallel to the first extension 52. The second extension 54 is generally horizontally aligned with the first extension 52. For example, the second extension 54 may be positioned adjacent to the final outlet vent 38 of the plurality of outlet vents 34.

An enclosure 56 may be positioned between the first lateral side 48 and the second lateral side 50 of the wall 46. The enclosure 56 may be centrally positioned within the housing 12. The enclosure 56 generally surrounds the processor 22 and the motor 24 wherein the enclosure 56 is configured to direct airflow around the processor 22 and the motor 24. The enclosure 56 may further increase the negative pressure near the plurality of inlet vents 26 by further constricting an area in which air can move within the housing 12 near the plurality of inlet vents 26 in comparison to an area in which air can move near the plurality of outlet vents 34. The enclosure 56 may also dampen the noise of sound waves emitted by the motor 24, particularly in embodiments where the wall 46 includes the soundproofing material.

Figure 11:
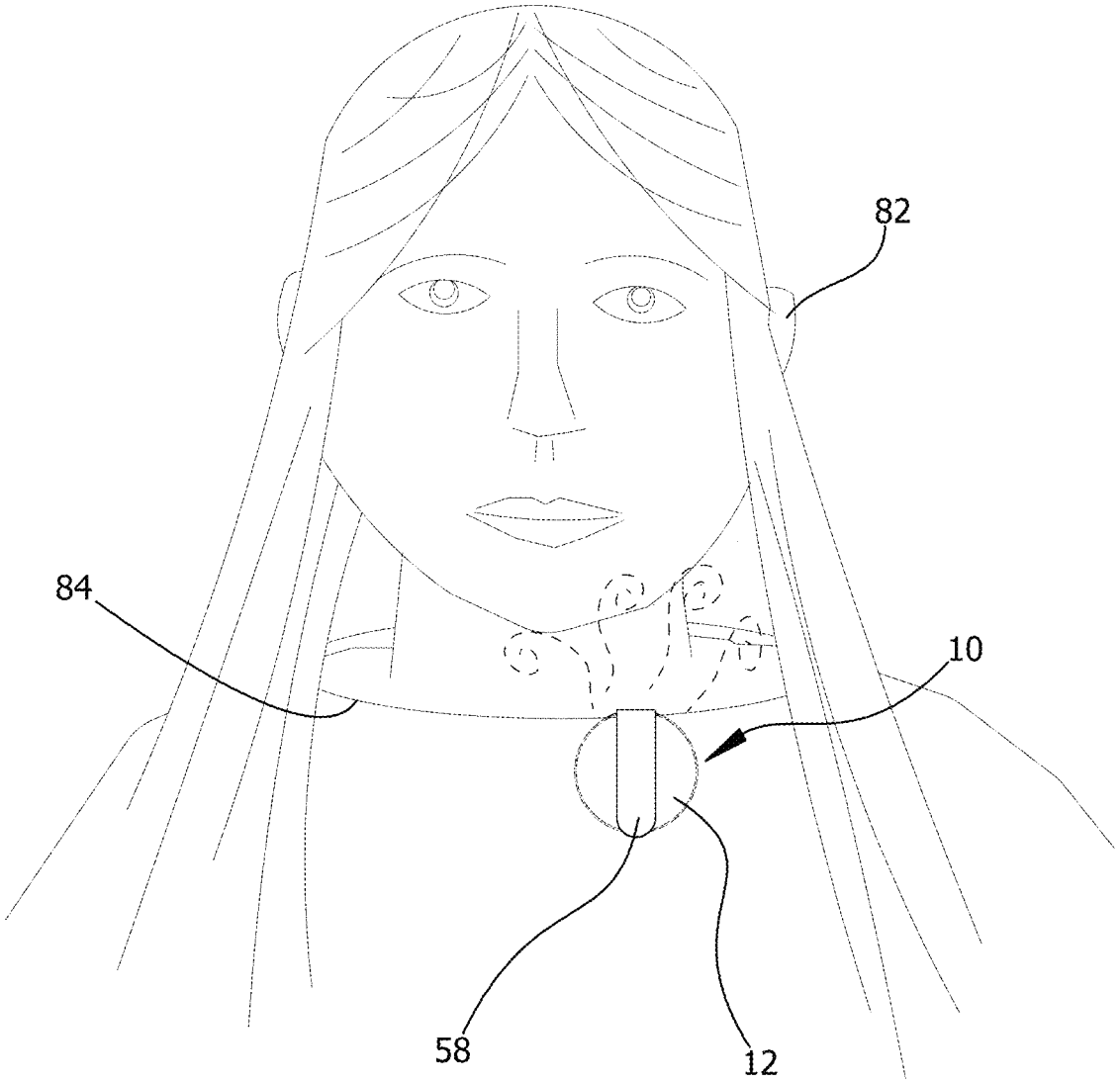
FIG. 11 is an in-use view of an embodiment of the disclosure.

A clip 58 may be coupled to the housing 12 wherein the clip 58 is configured to removably secure the housing 12 to a user 82. The clip 58 is generally positioned on the back side 18 of the housing 12. For example, the clip 58 may be engageable with an article of clothing 84, such as a shirt, of the user 82, as shown in FIG. 11. The clip 58 may removably secure the housing 12 to the article of clothing 84 such that the plurality of outlet vents 34 are directed toward a face of the user 82 to release air upwardly toward the face of the user 82. Alternatively, the clip 58 may secure the housing 12 to a backpack, a bag, a purse, a belt, a lanyard, or another object of the user 82 to direct moving air toward the user 82 and cool the user 82 down.

The clip 58 may include a plastic material that is coated in a silicone rubber material. For example, the silicone rubber material may be configured to inhibit the clip 58 from damaging the article of clothing 84. The silicone rubber material may also be configured to increase friction between the clip 58 and the article of clothing 84 to inhibit the clip 58 from falling off of the article of clothing 84.

The clip 58 may include a top end 60 and a bottom end 62. The clip 58 may have a length that is measured between the top end 60 and the bottom end 62. The length may exceed a diameter of the back side 18. An outer surface 64 of the clip 58 may be planar. The outer surface 64 may be concavely arcuate between the top end 60 and the bottom end 62. An inner surface 66 of the clip 58 may be convexly arcuate between the top end 60 and the bottom end 62. A plurality of ridges 68 may be coupled to and extending from the inner surface 66 toward the back side 18 of the housing 12. The plurality of ridges 68 may be pointed. The plurality of ridges 68 are generally configured to secure the clip 58 to the article of clothing 84, accessory, or other object of the user 82.

A control 70 may be electrically coupled to the processor 22. The control 70 is generally actuatable to signal the processor 22 to actuate the motor 24. The control 70 may be positioned on the front side 16 of the housing 12. For example, the control 70 may be centered on the front side 16 of the housing 12. The control 70 may include a button having a forward surface 72. The forward surface 72 may be concavely arcuate, wherein the forward surface 72 is configured to inhibit the control 70 from being actuated until the button is pressed by the user 82.

The button may be pressed to turn the motor 24 on and off. The button may also be pressed to adjust a speed at which the motor 24 rotates the propeller 42, thereby adjusting a speed at which air is released through the plurality of outlet vents 34. For example, the button may be pressed and held for a number of seconds (such as 3 seconds) to turn the motor 24 on or off. The button may be pressed and immediately released to cycle the motor 24 through a variety of pre-programmed speeds at which the motor 24 rotates the propeller 42. The pre-programmed speeds may include a "low speed," a "medium speed," and a "high speed" to provide each of a low airflow, a medium airflow, and a high airflow, respectively, for the user 82.

A power source 74 may be electrically coupled to the processor 22. The power source 74 is generally positioned within the interior space 14. For example, the power source 74 may be positioned between the first lateral side 48 of the wall 46 and the peripheral side 20 of the housing 12. The power source 74 may be a battery, and the battery may be rechargeable.

Figure 10:
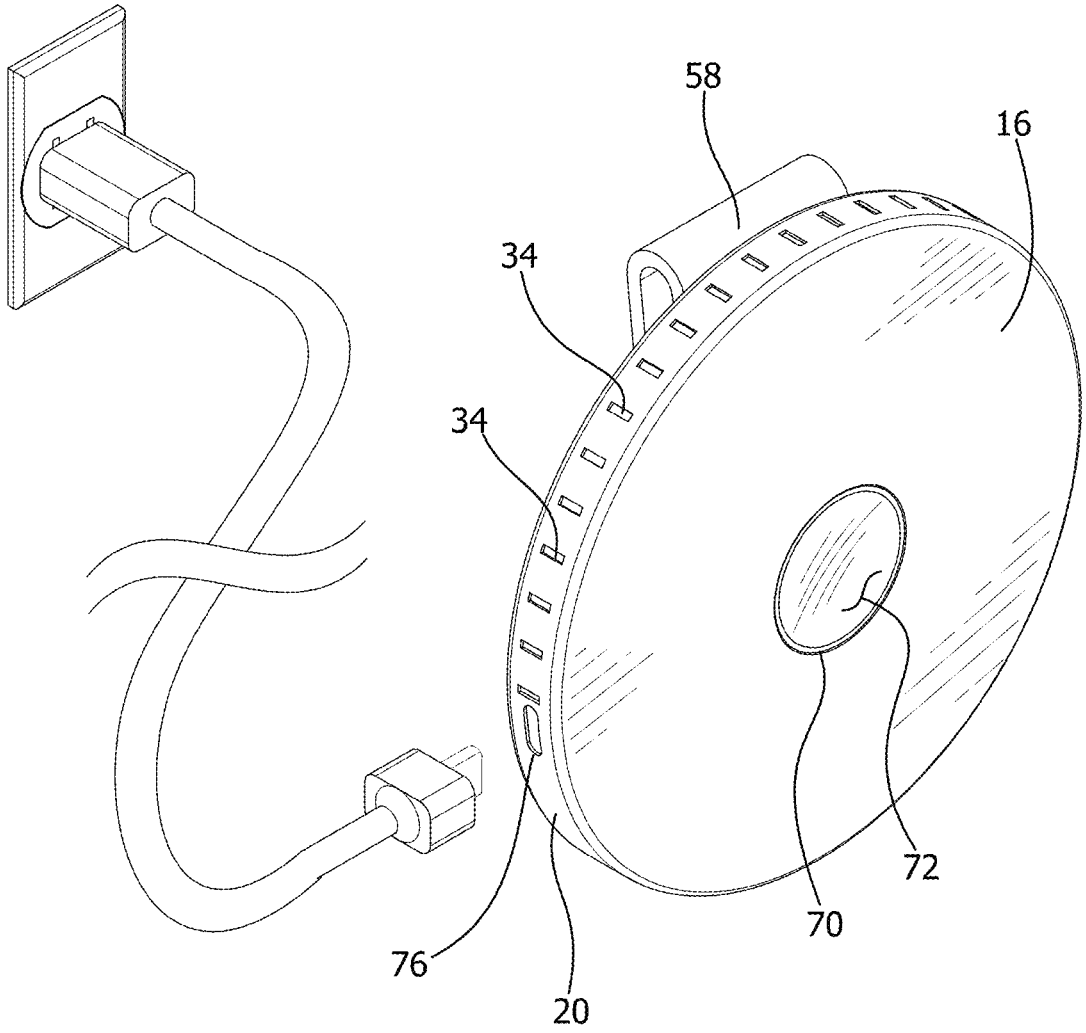
FIG. 10 is a perspective view of an embodiment of the disclosure.

A charging port 76 may be electrically coupled to the power source 74 wherein the charging port 76 facilitates recharging the power source 74. The charging port 76 may be positioned adjacent to one of the first outlet vent 36 and the final outlet vent 38 of the plurality of outlet vents 34. The charging port 76 may be inset into the peripheral side 20 of the housing 12. The charging port 76 may be exposed within the peripheral side 20 of the housing 12. The charging port 76 may be configured to receive a universal serial bus charging cord, as shown in FIG. 10.

The back side 18 of the housing 12 may be rotatably coupled to the peripheral side 20 of the housing 12 wherein the back side 18 is rotatable to adjust a position of the clip 58 relative to the plurality of outlet vents 34. Rotation of the back side 18 may be configured to facilitate the user 82 in adjusting a direction of airflow through the plurality of outlet vents 34 relative to the user 82.

In such embodiments, the housing 12 may further include a groove 78 that extends into the peripheral side 20 of the housing 12. A tongue 80 may extend from the back side 18 into the groove 78 in the peripheral side 20 of the housing 12. The tongue 80 may be movably positioned within the groove 78 to facilitate rotation of the back side 18 of the housing 12. The tongue 80 may be secured within the groove 78 by a friction fit wherein friction between the tongue 80 and the groove 78 is sufficient to releasably or temporarily retain a position of the back side 18 relative to the peripheral side 20 of the housing 12, inhibiting the back side 18 of the housing 12 from rotating freely.

In use, the housing 12 can be secured to the user 82, for example by engaging the clip 58 with the article of clothing 84, or to an accessory or other object of the user 82. As shown in FIG. 11, the housing 12 may be secured to the shirt of the user 82 with the plurality of outlet vents 34 directed upwardly toward the face of the user 82. When the motor 24 is actuated to rotate the propeller 42 about the axis 44, the propeller 42 will draw air inwardly through the plurality of inlet vents 26, upwardly through the channel 88 within the interior space 14, and outwardly through the plurality of outlet vents 34. To adjust the direction of the airflow relative to the user 82, the back side 18 can be rotated. Because the propeller 42 is positioned near the plurality of inlet vents 26 and enclosed within the wall 46 defining the channel 88, the propeller 42 may operate silently, or nearly silently, allowing the user 82 to discreetly cool themselves off regardless of the location where the user 82 is located.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal cooling assembly comprising:
a housing having an interior space;
a processor being positioned within the interior space;
a motor being electrically coupled to the processor;
an inlet vent extending through the housing;
an outlet vent extending through the housing, the outlet vent being spaced from the inlet vent;
a propeller being operably coupled to the motor wherein the motor is actuatable to rotate the propeller, the propeller being rotatable about an axis extending between the inlet vent and the outlet vent;
a wall defining a channel extending through the interior space, the propeller being positioned within the channel, the channel being in fluid communication with the inlet vent and the outlet vent wherein the propeller is configured to draw air into the channel through the inlet vent and wherein the channel is configured to direct airflow through the housing to the outlet vent;
a clip being coupled to the housing wherein the clip is configured to removably secure the housing to a user;
the wall further comprising:
a first lateral side;
a second lateral side, the propeller being positioned between the first lateral side and the second lateral side;
the first lateral side and the second lateral side being angled to extend upwardly from the inlet vent and outwardly relative to each other wherein a distance between the first lateral side and the second lateral side increases moving away from the inlet vent; and
an enclosure being positioned between the first lateral side and the second lateral side, the enclosure surrounding the processor and the motor wherein the enclosure is configured to direct airflow around the processor and the motor.

2. The personal cooling assembly of claim 1, further comprising a control being electrically coupled to the processor, the control being actuatable to signal the processor to actuate the motor.

3. The personal cooling assembly of claim 2, wherein the control is positioned on a front side of the housing, the control including a button having a forward surface being concavely arcuate wherein the forward surface is configured to inhibit the control from being actuated until the button is pressed by the user.

4. The personal cooling assembly of claim 1, the housing further comprising a front side, a back side, and a peripheral side being coupled to and extending between the front side and the back side to define the interior space, the clip being positioned on the back side of the housing, the back side of the housing being rotatably coupled to the peripheral side of the housing wherein the back side is rotatable to adjust a position of the clip relative to the outlet vent and wherein rotation of the back side is configured to facilitate the user in adjusting a direction of airflow through the outlet vent.

5. The personal cooling assembly of claim 4, the clip further comprising:
a top end;
a bottom end;
an outer surface being concavely arcuate between the top end and the bottom end;
an inner surface being convexly arcuate between the top end and the bottom end; and
a plurality of ridges being coupled to and extending from the inner surface toward the back side of the housing wherein the plurality of ridges are configured to secure the clip to the user.

6. The personal cooling assembly of claim 4, wherein the inlet vent extends through the peripheral side of the housing and wherein the outlet vent extends through the peripheral side of the housing.

7. The personal cooling assembly of claim 1, the wall further comprising:
a first extension being coupled to and extending from the first lateral side to the housing, the first extension being perpendicular to the axis about which the propeller is rotated;
a second extension being coupled to and extending from the second lateral side to the housing, the second extension being parallel to the first extension.

8. The personal cooling assembly of claim 1, wherein the inlet vent is a middle inlet vent of a plurality of inlet vents, the plurality of inlet vents further comprising:
a primary inlet vent; and
a terminal inlet vent being spaced from the primary inlet vent, the middle inlet vent being positioned between the primary inlet vent and the terminal inlet vent.

9. The personal cooling assembly of claim 8, wherein the outlet vent is a central outlet vent of a plurality of outlet vents, the plurality of outlet vents further comprising:
a first outlet vent; and
a final outlet vent being spaced from the first outlet vent, the final outlet vent being aligned with the first outlet vent across the housing wherein the first outlet vent and the final outlet vent define an angle being between 160.0° and 200.0°, the central outlet vent being positioned between the first outlet vent and the final outlet vent.

10. The personal cooling assembly of claim 9, wherein the middle inlet vent is aligned with the central outlet vent along the axis about which the propeller is rotated.

11. The personal cooling assembly of claim 1, the wall further comprising a soundproofing material wherein the soundproofing material is configured to inhibit sound waves emitted by rotation of the propeller from travelling through the wall and outwardly from the housing.

12. A personal cooling assembly comprising:
a housing having an interior space;
a processor being positioned within the interior space;
a motor being electrically coupled to the processor;
an inlet vent extending through the housing;

an outlet vent extending through the housing, the outlet vent being spaced from the inlet vent;

a propeller being operably coupled to the motor wherein the motor is actuatable to rotate the propeller, the propeller being rotatable about an axis extending between the inlet vent and the outlet vent;

a wall defining a channel extending through the interior space, the propeller being positioned within the channel, the channel being in fluid communication with the inlet vent and the outlet vent wherein the propeller is configured to draw air into the channel through the inlet vent and wherein the channel is configured to direct airflow through the housing to the outlet vent;

a clip being coupled to the housing wherein the clip is configured to removably secure the housing to a user; and the housing further comprising:

a front side, a back side, and a peripheral side being coupled to and extending between the front side and the back side to define the interior space, the clip being positioned on the back side of the housing, the back side of the housing being rotatably coupled to the peripheral side of the housing wherein the back side is rotatable to adjust a position of the clip relative to the outlet vent and wherein rotation of the back side is configured to facilitate the user in adjusting a direction of airflow through the outlet vent;

a groove extending into the peripheral side of the housing; and a tongue extending from the back side into the groove in the peripheral side of the housing, the tongue being movably positioned within the groove to facilitate rotation of the back side of the housing.

13. A personal cooling assembly comprising:

a housing having an interior space, the housing having a front side, a back side, and a peripheral side being coupled to and extending between the front side and the back side to define the interior space;

a processor being positioned within the interior space;

a motor being electrically coupled to the processor, the motor being positioned within the interior space, the motor being a brushless electric motor;

a plurality of inlet vents extending through the peripheral side of the housing, the plurality of inlet vents including:

a primary inlet vent;

a terminal inlet vent being spaced from the primary inlet vent;

a middle inlet vent being centered between the primary inlet vent and the terminal inlet vent;

a plurality of outlet vents extending through the peripheral side of the housing, the plurality of outlet vents being spaced from the plurality of inlet vents, the plurality of outlet vents including:

a first outlet vent;

a final outlet vent being spaced from the first outlet vent, the final outlet vent being horizontally aligned with the first outlet vent across the front side of the housing wherein the first outlet vent and the final outlet vent define an angle being 180°; and a central outlet vent being vertically aligned with the middle inlet vent of the plurality of inlet vents across the housing;

a propeller being operably coupled to the motor wherein the motor is actuatable to rotate the propeller, the propeller being positioned within the interior space, the propeller being positioned adjacent to the plurality of inlet vents, the propeller being rotatable about an axis extending between the middle inlet vent of the plurality of inlet vents and the central outlet vent of the plurality of outlet vents wherein rotation of the propeller is configured to draw air inwardly through the plurality of inlet vents and direct air outwardly through the plurality of outlet vents;

a wall being positioned within the interior space, the wall defining a channel extending through the interior space, the channel being in fluid communication with the plurality of inlet vents and with the plurality of outlet vents wherein the propeller is configured to draw air into the channel through the plurality of inlet vents and wherein the channel is configured to direct airflow through the housing to the plurality of outlet vents, the propeller being positioned within the channel, the wall including a soundproofing material wherein the soundproofing material is configured to inhibit sound waves emitted by rotation of the propeller from travelling through the wall and outwardly from the housing, the wall including:

a first lateral side being positioned proximate to the primary inlet vent of the plurality of inlet vents wherein the first lateral side is spaced from the middle inlet vent;

a second lateral side being positioned proximate to the terminal inlet vent of the plurality of inlet vents wherein the second lateral side is spaced from the middle inlet vent, the propeller being positioned between the first lateral side and the second lateral side;

the first lateral side and the second lateral side being angled to extend upwardly from the peripheral side proximate to the plurality of inlet vents and outwardly relative to each other wherein a distance between the first lateral side and the second lateral side increases moving away from the plurality of inlet vents;

a first extension being coupled to and extending from the first lateral side to the peripheral side of the housing, the first extension being perpendicular to the axis about which the propeller is rotated, the first extension being positioned adjacent to the first outlet vent of the plurality of outlet vents;

a second extension being coupled to and extending from the second lateral side to the peripheral side of the housing, the second extension being parallel to the first extension, the second extension being horizontally aligned with the first extension wherein the second extension is positioned adjacent to the final outlet vent of the plurality of outlet vents;

an enclosure being positioned between the first lateral side and the second lateral side, the enclosure surrounding the processor and the motor wherein the enclosure is configured to direct airflow around the processor and the motor;

a clip being coupled to the back side of the housing wherein the clip is configured to removably secure the housing to an article of clothing of a user, the clip including:

a top end;

a bottom end, the clip having a length being measured between the top end and the bottom end, the length exceeding a diameter of the back side;

an outer surface being planar, the outer surface being concavely arcuate between the top end and the bottom end;

an inner surface being convexly arcuate between the top end and the bottom end; and a plurality of ridges being coupled to and extending from the inner surface toward the back side of the housing wherein the plurality of ridges are configured to secure the clip to the article of clothing of the user;

a control being electrically coupled to the processor, the control being actuatable to signal the processor to actuate the motor, the control being positioned on the front side of the housing, the control being centered on the front side of the housing, the control including a button having a forward surface being concavely arcuate wherein the forward surface is configured to inhibit the control from being actuated until the button is pressed by the user;

a power source being electrically coupled to the processor, the power source being positioned within the interior space, the power source being positioned between the first lateral side of the wall and the peripheral side of the housing, the power source being a battery, the battery being rechargeable;

a charging port being electrically coupled to the power source wherein the charging port facilitates recharging the power source, the charging port being inset into the peripheral side of the housing, the charging port being exposed within the peripheral side of the housing, the charging port being configured to receive a universal serial bus charging cord, the charging port being positioned adjacent to the first outlet vent of the plurality of outlet vents; and the back side of the housing being rotatably coupled to the peripheral side of the housing wherein the back side is rotatable to adjust a position of the clip relative to the plurality of outlet vents and wherein rotation of the back side is configured to facilitate the user in adjusting a direction of airflow through the plurality of outlet vents, the housing further including:

a groove extending into the peripheral side of the housing; and a tongue extending from the back side into the groove in the peripheral side of the housing, the tongue being movably positioned within the groove to facilitate rotation of the back side of the housing.

* * * * *